US009416932B2

(12) United States Patent
Johnson et al.

(10) Patent No.: US 9,416,932 B2
(45) Date of Patent: Aug. 16, 2016

(54) SYSTEM FOR PROJECTING A SIMULATED LIQUID SURFACE

(71) Applicant: Cloud B, Inc., Gardena, CA (US)

(72) Inventors: Jeffery Wayne Johnson, Lawndale, CA (US); Linda Suh, Palo Verdes Estates, CA (US)

(73) Assignee: CLOUD B, INC., Gardena, CA (US)

( * ) Notice: Subject to any disclaimer, the term of this patent is extended or adjusted under 35 U.S.C. 154(b) by 0 days.

(21) Appl. No.: 14/840,542

(22) Filed: Aug. 31, 2015

(65) Prior Publication Data

US 2016/0161072 A1 Jun. 9, 2016

Related U.S. Application Data

(63) Continuation of application No. 14/315,130, filed on Jun. 25, 2014, now Pat. No. 9,121,559, which is a continuation of application No. PCT/US2013/024190, filed on Jan. 31, 2013.

(60) Provisional application No. 61/592,992, filed on Jan. 31, 2012.

(51) Int. Cl.

| | |
|---|---|
| ***F21S 10/00*** | (2006.01) |
| ***F21V 5/00*** | (2015.01) |
| ***F21V 14/06*** | (2006.01) |

(Continued)

(52) U.S. Cl.

CPC ..... *F21S 10/00* (2013.01); *F21V 5/008* (2013.01); *F21V 5/04* (2013.01); *F21V 13/02* (2013.01); *F21V 14/06* (2013.01);

(Continued)

(58) Field of Classification Search

CPC ..... F21S 10/00; F21V 5/008; F21V 5/04; F21V 13/02; F21V 14/06; F21V 33/0056

See application file for complete search history.

(56) References Cited

U.S. PATENT DOCUMENTS 3,393,310 A * 7/1968 Ream ..... F21S 8/035 353/4

4,217,040 A 8/1980 Longerbeam (Continued)

FOREIGN PATENT DOCUMENTS

GB 296884 A 9/1928

OTHER PUBLICATIONS

European Search Report for Application No. 13743955.0, mailed Aug. 26, 2015.

(Continued)

*Primary Examiner* — Mary Ellen Bowman

(74) *Attorney, Agent, or Firm* — Brooks Acordia IP Law, PC; James K. Dawson

(57) ABSTRACT

A projector apparatus that may include a first plurality of adjacent translucent lenses on at least one side of an inner lens, said inner lens configured to rotate and translate about an axis (A) of the inner lens; a second plurality of adjacent translucent lenses formed on at least one side of a concave outer lens; a light source configured to direct a portion of light through the rotatable and translatable inner lens and then through the concave outer lens; and a motor configured to rotatably and translatably drive the inner lens in an oscillating manner about and along the axis of the concave inner lens (A); so that the oscillating inner lens imparts a moving textured image for modification through the fixed concave outer lens for display upon a surface, such as a ceiling to simulate a moving liquid surface.

16 Claims, 5 Drawing Sheets

(51) Int. Cl.

| | |
|---|---|
| ***F21V 5/04*** | (2006.01) |
| ***F21V 13/02*** | (2006.01) |
| ***F21V 33/00*** | (2006.01) |
| *F21W 121/00* | (2006.01) |
| *F21Y 101/02* | (2006.01) |

(52) U.S. Cl.
CPC ..... *F21V 33/0056* (2013.01); *F21W 2121/00* (2013.01); *F21Y 2101/02* (2013.01)

(56) References Cited

U.S. PATENT DOCUMENTS

| | | | | |
|---|---|---|---|---|
| 5,307,051 | A | 4/1994 | Sedlmayr | |
| 5,455,755 | A | 10/1995 | Bandy | |
| 5,902,032 | A | 5/1999 | Hannigan et al. | |
| 6,572,245 | B2 * | 6/2003 | Stekelenburg | H01R 24/68 362/276 |
| 7,329,035 | B2 | 2/2008 | Feliciano | |
| 7,997,785 | B2 | 8/2011 | Chien | |
| 2002/0089856 | A1 | 7/2002 | Vogel et al. | |
| 2007/0097681 | A1 | 5/2007 | Chich et al. | |
| 2007/0242225 | A1 * | 10/2007 | Bragg | G03B 31/04 352/12 |
| 2010/0277952 | A1 * | 11/2010 | Chien | F21S 4/008 362/641 |

OTHER PUBLICATIONS

International Search Report for PCT/US13/24190, mailed May 23, 2013.
Notification of Transmittal of International Preliminary Report on Patentability, mailed May 14, 2014.
Non-Final Office action for U.S. Appl. No. 14/315,130, mailed Jan. 13, 2015.
Notice of Allowance for U.S. Appl. No. 14/315,130, mailed Apr. 22, 2015.

* cited by examiner

FIG. 8
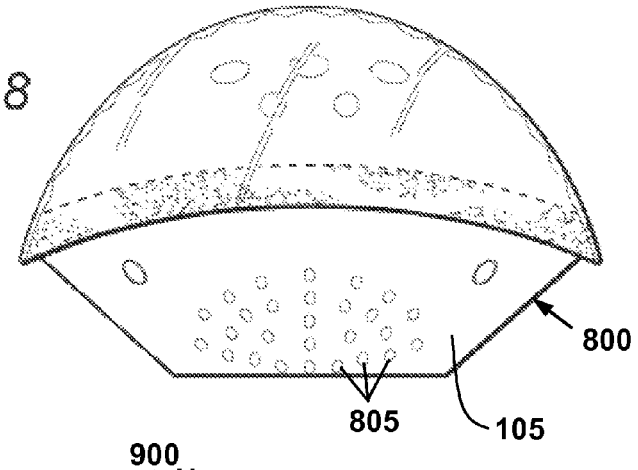
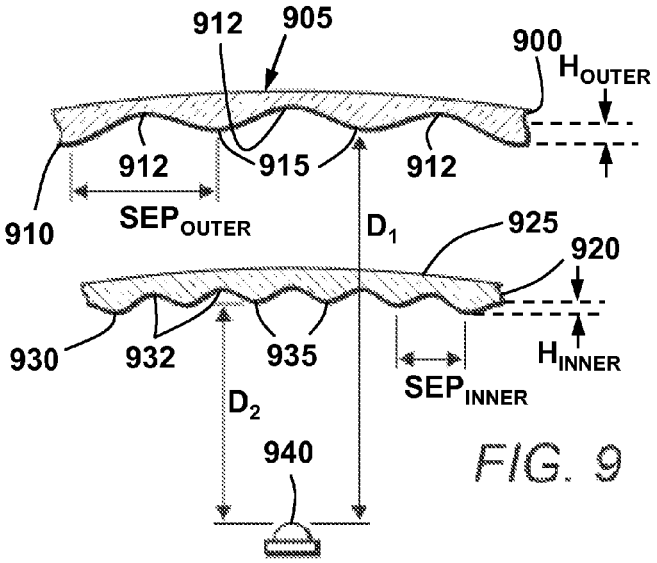
FIG. 9
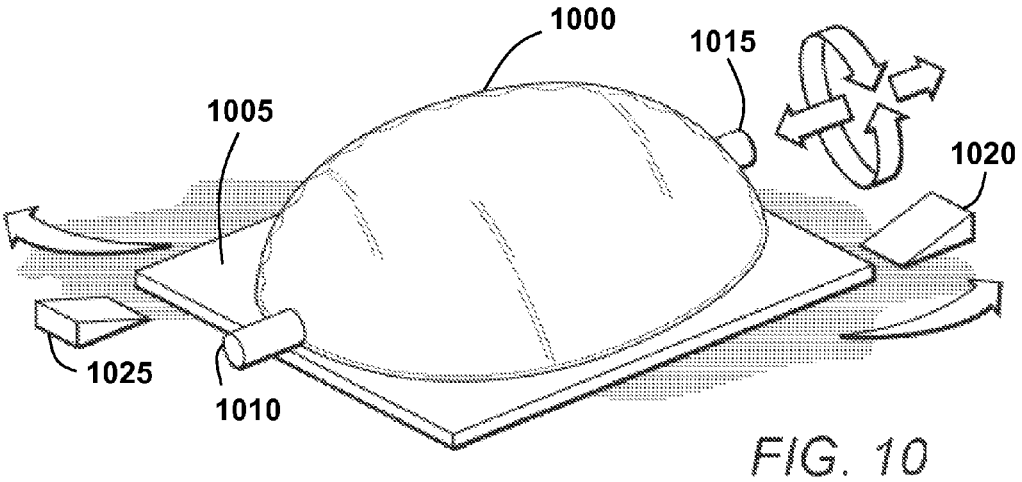
FIG. 10

FIG. 11A
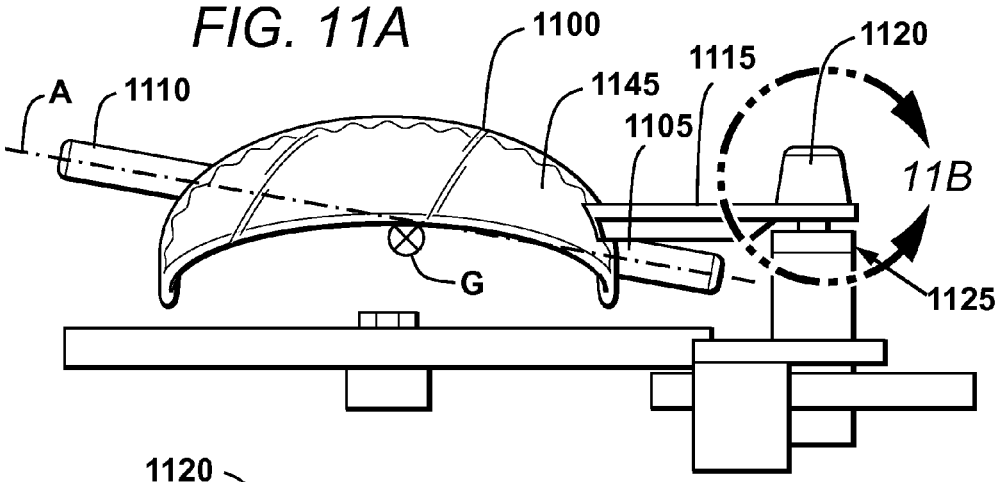
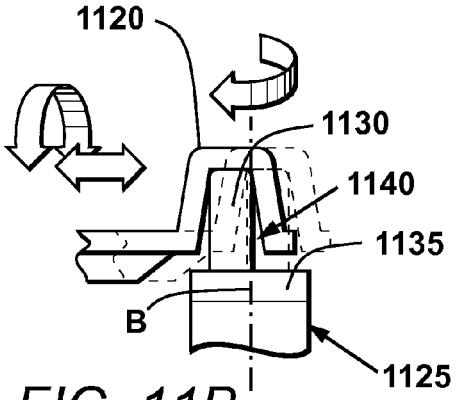
FIG. 11B
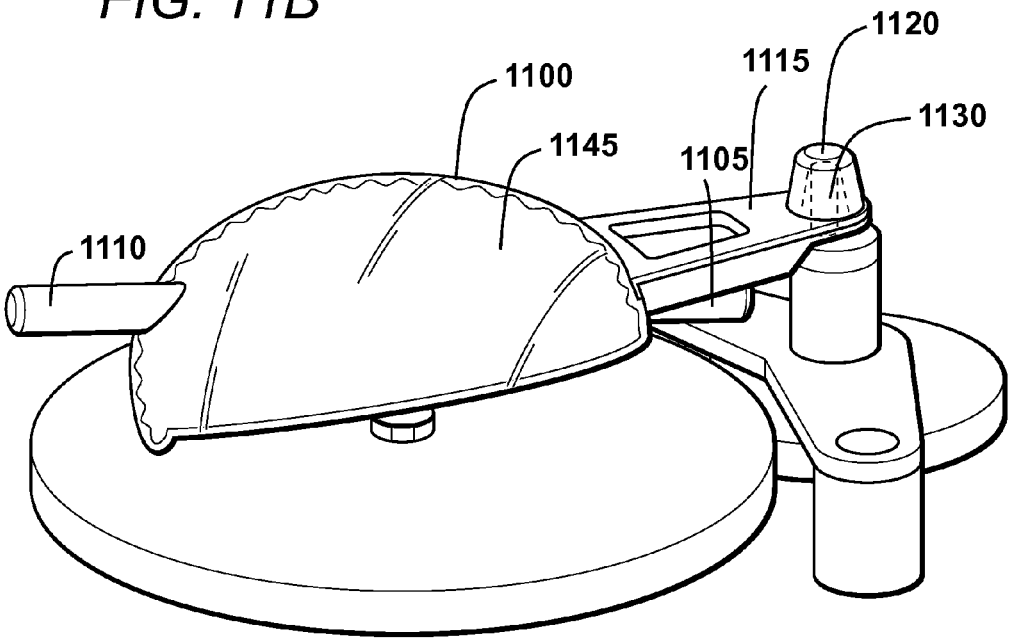
FIG. 12

SYSTEM FOR PROJECTING A SIMULATED LIQUID SURFACE

CROSS-REFERENCE TO RELATED APPLICATION

This application is a continuation of U.S. non-provisional application Ser. No. 14/315,130 filed Jun. 25, 2014, which claims priority to and the benefit of International Application No. PCT/US13/24190 filed Jan. 31, 2013, which claims priority to and the benefit of U.S. Provisional Patent Application Ser. No. 61/592,992, filed Jan. 31, 2012, the disclosures of each of which are incorporated by reference herein for all purposes.

BACKGROUND

1. Field of the Invention

The field of the invention relates to electro-optical systems, and more particular to nightlights for children that project an image on a surface.

2. Description of the Related Art

Small light fixtures, sound generators and comforting objects such as stuffed toy animals are often used by parents of young children to provide the children with a sense of emotional comfort and security when trying to go to sleep at night. With improved emotional comfort and security comes improved sleep for children. Nightlights, a kind of light fixture, may also provide parents with a temporary source of light to navigate a bedroom without the need to turn on more general room lighting.

A need still exists for products that provide improved emotional comfort and security for children at night to improve the quality of their sleep.

SUMMARY

A projector apparatus is disclosed that has a first plurality of adjacent translucent lenses on at least one side of an inner lens, the inner lens configured to rotate and translate about an axis of the inner lens, a second plurality of adjacent translucent lenses formed on at least one side of a concave outer lens, a light source configured to direct a portion of light through the rotatable and translatable inner lens and then through the concave outer lens, and a motor configured to rotatably and translatably drive the inner lens in an oscillating manner about and along the axis of the concave inner lens. With such a configuration, the oscillating inner lens imparts a moving textured image for modification through the fixed concave outer lens for display upon a surface such as a ceiling to simulate a moving liquid surface. In one embodiment, the second plurality of adjacent translucent lenses have optical axes that are spaced farther apart than the optical axes of the second plurality of adjacent lenses. The first plurality of adjacent translucent lenses may be a first patterned surface on the concave inner lens. In such an embodiment, the second plurality of adjacent translucent lenses may be a second patterned surface on the concave outer lens. The pattern of the second patterned surface may be proportionally larger than the pattern of the first patterned surface. In a further embodiment, the light source, the inner lens and the concave outer lens may be collectively configured to provide light through a viewing angle of approximately 180-degrees viewable. The inner lens may be a concave inner lens and the concave outer lens may be a translucent toy turtle shell. In one embodiment, the axis of the inner lens along which the inner lens is configured to translate is tilted toward the concave outer lens. In another embodiment, the axis of the inner lens along which the inner lens is configured to translate may be above the center of gravity of the inner lens.

A projector apparatus is also disclosed that has an inner lens, the inner lens having a first plurality of optical axes, an outer lens, the outer lens having a second plurality of optical axes, a light source configured to direct a portion of light through the inner and outer lenses, and a motor configured to rotatably and translatably drive at least one of the inner and outer lenses in an oscillating manner about and along a respective pivot axis of at least one of the inner and outer lenses, so that at least one of the inner and outer lenses imparts a moving textured image for display upon a surface such as a ceiling to simulate a moving liquid surface. Each of at least one of the inner and outer lenses may have a pivot axis that is gravitationally above its center of gravity during up-right operation. The second plurality of optical axes of the outer lens may be spaced farther apart than the first plurality of optical axes of the inner lens. In another embodiment, the first plurality of optical axes of the inner lens may be spaced farther apart than the second plurality of optical axes of the outer lens. The light source, the inner lens and the concave outer lens may be collectively configured to provide light through a viewing angle of approximately 180-degrees. In another embodiment, the outer lens may be a translucent toy turtle shell.

A method of projecting a simulated moving liquid surface is disclosed that includes rotating and translating a patterned inner lens, and projecting light through said rotating and translating patterned inner lens and then through a fixed patterned outer lens so that the rotating and translating the patterned inner lens imparts a moving textured image for presentation to the fixed patterned outer lens for display upon a surface such as a ceiling to simulate a moving liquid surface. In one embodiment, the rotation and translation axes are co-located. In another embodiment, the co-located rotation and translation axes are above the center of gravity of the patterned inner lens. The method may also include changing an emission color of the projected light and may include providing sounds of liquid movement, music, or other desired soothing sounds through a speaker.

BRIEF DESCRIPTION OF THE DRAWINGS

The components in the figures are not necessarily to scale, emphasis instead being placed upon illustrating the principals of the invention. Like reference numerals designate corresponding parts throughout the different views.

FIG. 8 is a front plan view of an assembled projector system having a plurality of holes for transmission of sound from an interior to an exterior of the assembly;

FIG. 9 is a cross-section view illustrating a portion of the concave outer lens and inner lens as assembled in FIG. 1;

FIG. 10 is a top perspective view of an alternative embodiment for providing rotation and translation of the inner shell during operation; and FIGS. 11A-B and 12 are side plan, close-up, and perspective views of another embodiment of an inner lens having a center of gravity below a rotation and translation axis.

DETAILED DESCRIPTION

A projector system is disclosed that may include an oscillating and translating inner patterned lens and an outer fixed patterned lens. A light source may illuminate the oscillating and translating inner patterned lens for presentation of the inner patterned lens image through the outer fixed patterned lens for display of the resulting moving image on a surface such as a darkened ceiling. The light source may provide an emitted color and/or lenses may provide a filtered color for aesthetic coloration of the light and an internal speaker may provide optional moving water, music or other soothing sounds. The resulting projection and sound may simulate a moving liquid surface on a ceiling of a darkened bedroom to provide improved emotional comfort and security for children at night to improve the quality of their sleep.

Figure 1:
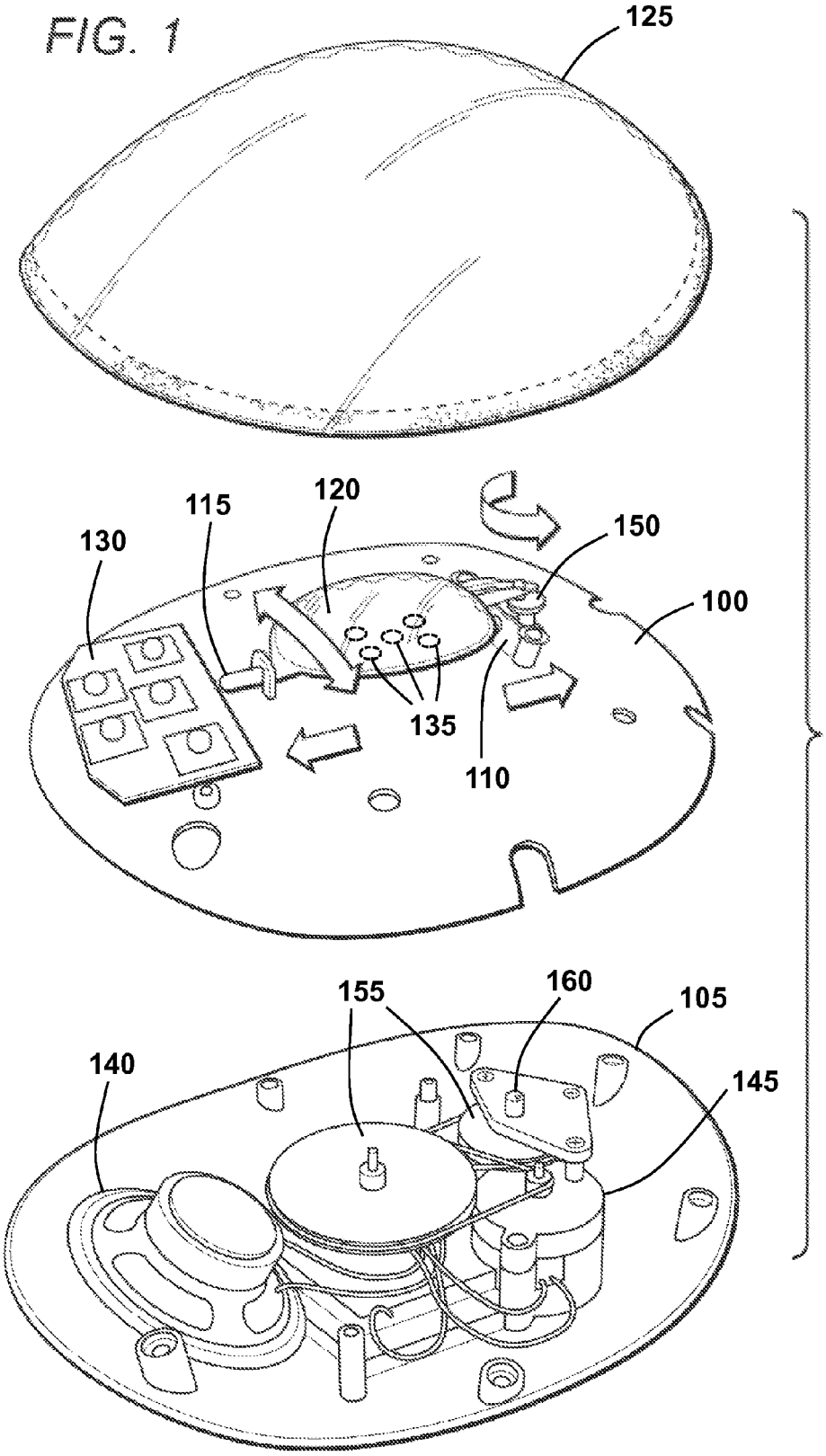
FIG. 1 is an exploded perspective view of one embodiment of a projector system having an inner oscillating and translating lens and a fixed outer lens for simulating a moving liquid surface on a ceiling of a darkened bedroom.

FIG. 1 is an exploded perspective view of one embodiment of the projector system that may present a plurality of light beams from a light source through an oscillating and translating inner patterned lens, and subsequently through an outer concave lens, to project a simulated moving liquid surface on a ceiling (i.e., "up-right operation"). The projector system includes a lens platform 100 coupled to an electronics assembly tray 105. First and second hinges 110, 115 rotatably and translatably support an inner lens that may be a concave inner lens 120. A concave outer lens 125 may be coupled to the electronics assembly tray 105 through the lens platform 100, or may couple to the lens platform 100, itself. A switch assembly 130 is preferably seated on the lens platform 100 to accept respective switch extensions (not shown) that extend through the concave outer lens 125 to an exterior of the outer lens. A light source may include a plurality of colored LEDs 135. The light source is preferably positioned in complementary opposition to the concave inner lens 120 to direct a portion of the light through the inner lens 120 and then through the concave outer lens 125. The electronics assembly tray 105 may have a speaker 140 to provide simulated liquid sounds to an exterior of the assembly. The electronics assembly tray 105 may also have an electric motor 145 coupled to an inner lens driver 150 through gear reduction pulleys 155 and a pulley spinner post 160, with the gear reduction pulleys 155 preferably providing a rotation speed for the puller spinner post of approximately 8-12 rpm to drive the inner lens 120 in an oscillating rotational movement. In an alternative embodiment, gear reduction may be accomplished through a series of gears or other means of reducing the rpm of the motor to provide the desired oscillating rotational movement of the inner lens 120.

Figure 2:
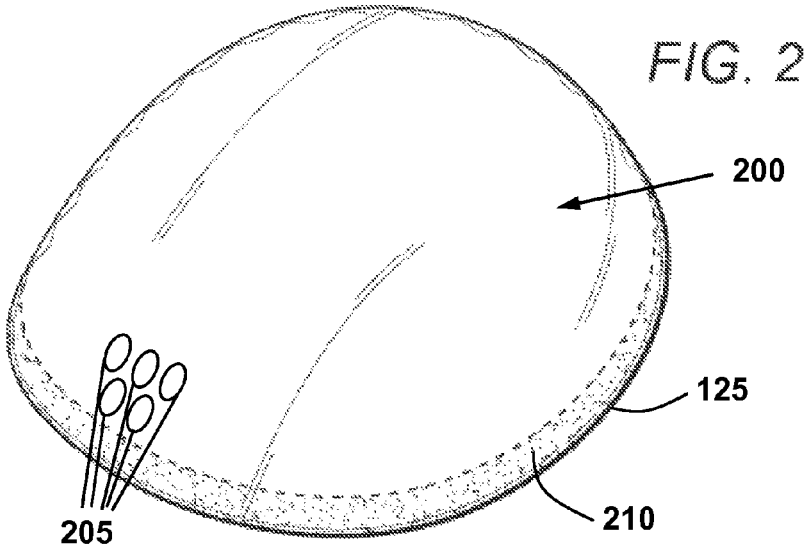
FIG. 2 is a perspective view of the concave outer lens first illustrated in FIG. 1.

FIG. 2 is a perspective top view of one embodiment of the concave outer lens first illustrated in FIG. 1. The concave outer lens 125 may have a smooth outer surface 200 having a generally elliptical cross section. A plurality of switch extension guide holes 205 extend from the outer surface 200 through the outer lens 125 to its interior in complementary opposition to respective switches on the switch assembly 130 (See FIG. 1). The concave outer lens 125 may be formed of colored translucent plastic, such as blue-tinted acrylic or other thermoplastic or thermosetting polymer. In another embodiment, the concave outer lens 125 may be formed of glass, such as clear or frosted glass, or other transparent or partially translucent material that may be either clear or provided with a coloring to act as a color filter. The concave outer lens 125 may have a filter 210 formed or printed on the outer perimeter of the concave outer lens 125 to filter emitted light that may have escaped without passing through the inner lens 120 (See FIG. 1) during operation. The filter 210 may be defined by a thicker portion of the concave outer lens 125, such as a thicker band or pattern of the material forming the concave outer lens 125, or may be printed on the concave outer lens with ink or other neutral-density filtering or color filtering. The filter 210 may exist as an uninterrupted band about the outer perimeter of the concave outer lens 125 or may be formed of an intermittent band of material. In a preferred embodiment, the concave outer lens 125 forms approximately a half-shell and is intended to imitate the upper shell of a toy turtle in shape. In an alternative embodiment, the concave outer lens is rectangular, semicircular or elliptical in cross section.

Figure 3:
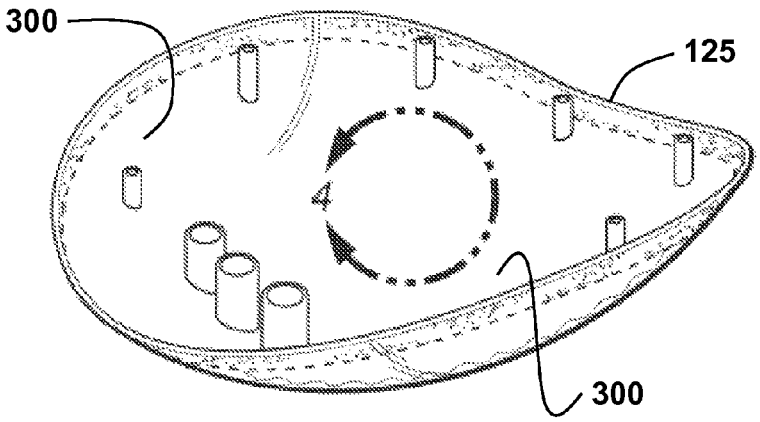
FIGS. 3 and 4 are perspective bottom and close-up bottom views of the outer lens illustrated in FIGS. 1 and 2.
Figure 4:
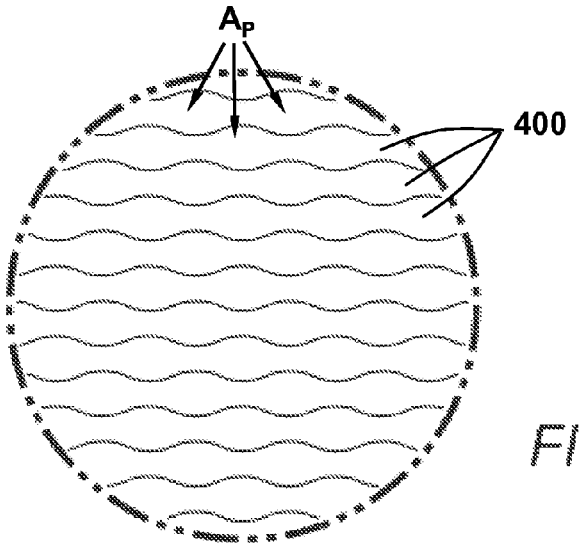

FIGS. 3 and 4 are a perspective bottom view and close-up of the bottom, respectively, of the concave outer lens illustrated in FIG. 2. An interior surface 300 may have a plurality of adjacent lenses 400, alternatively referred to as "patterned" lenses, formed during the molding process of the concave outer lens 125 during manufacturing. The plurality of adjacent lenses 400 have a principal axis $A_p$ spaced apart from each other in what may be a regular repeating pattern. The plurality of adjacent lenses 400 preferably extend through the entire interior surface 300, or may extend around a partial circumference of the interior surface 300.

Figure 5:
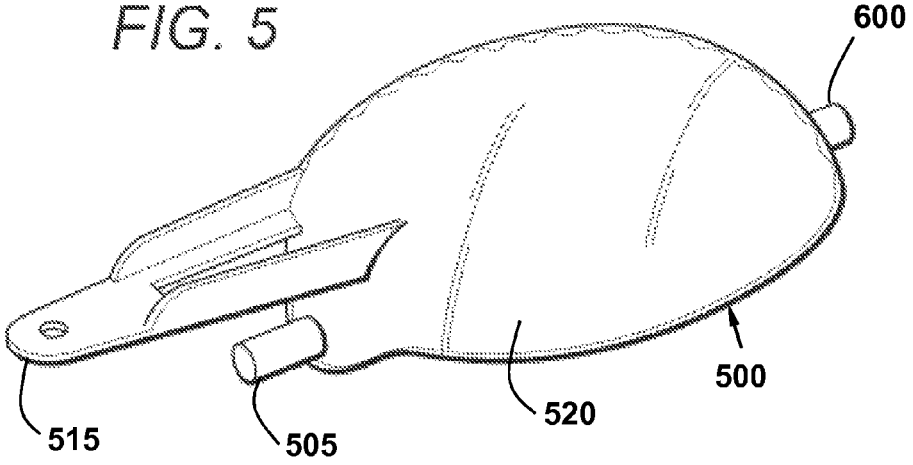
FIGS. 5 and 6 are perspective and top plan views of one embodiment of an inner lens.
Figure 6:
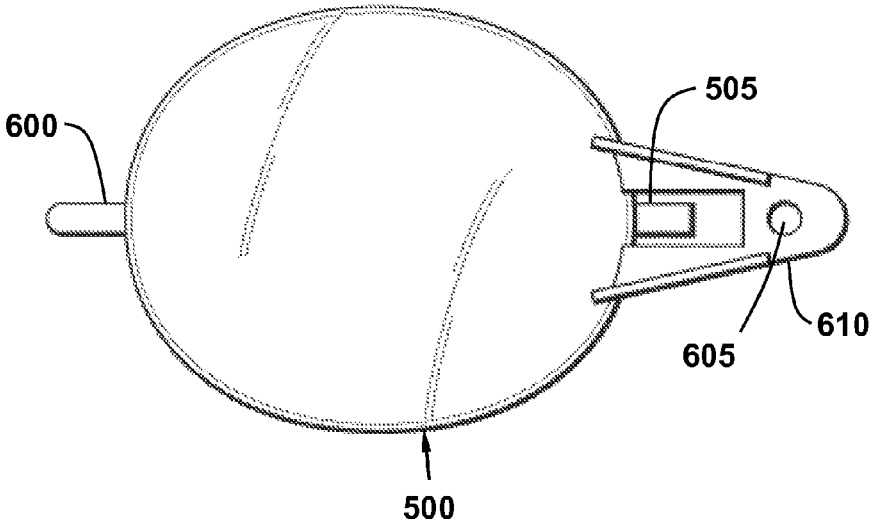

FIGS. 5 and 6 are perspective and top plan views of one embodiment of an inner lens. In this embodiment, the inner lens 500 has front and rear pins (505, 600) extending from opposing ends of the inner lens 500 to enable a rotatable and slidable coupling to the first and second hinges (110, 115) (See FIG. 1), respectively. A driver arm 515 extends from one end of the inner lens 500 to slidably receive an inner lens driver (not shown) connected to a motor, with the driver preferably providing both a rotational moment and translational movement to the inner lens 500 as guided by the front and rear pins (505, 600) rotatably and slidably coupled to the first and second hinges (110, 115), respectively. The inner lens driver (not shown) may be a post extending from a disk that rotates about a rotation axis that is perpendicular to the axis of rotation of the inner lens 500 to drive the driver arm 515 in a circular path that effectively pushes, pulls and rotates the driver arm 515 to impart a rotational moment about a rotation axis and translational path defined by the front and rear pins (505, 600). In an alternative embodiment, the driver arm 515 may instead be a post, cavity or other coupler extending from or on an outer surface 520 of the inner lens 500 to engage an inner lens driver having a complementary design to engage the driver arm.

As better illustrated in FIG. 6, a post guide hole 605 may extend through a distal end 610 of the driver arm 515 that itself extends from the inner lens 500 to receive the pulley spinner post 160 (See FIG. 1). In an alternative embodiment, the post guide hole 605 is instead a post to engage a complementary driver guide hole (not shown) that drives the inner lens 500 through the post. Although illustrated as generally elliptical, the inner lens may in an alternative embodiment be rectangular, semicircular or elliptical in cross section. Front and rear pins (505, 600) may be front and rear guide holes extending through the inner lens 500 to receive complementary guide posts or a single axle to establish the rotation axis and translational path for the inner lens 500.

Figure 7:
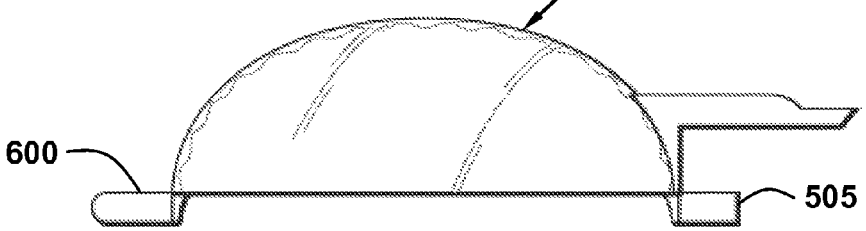
FIG. 7 is a side view of the inner lens illustrated in FIGS. 5 and 6.

FIG. 7 illustrates a side view of the inner lens illustrated in FIGS. 5 and 6. Front and rear pins (505, 600) extend from opposing ends of the inner lens 500 to define the axis of rotation and translation for the inner lens 500. The driver arm 515 may extend from one end of the inner lens 500 to provide an attachment for driving the inner lens 500 during operation. The inner lens 500 is illustrated as a half-shell in cross section. In an alternative embodiment, the inner lens 500 forms a half-square shape or other geometric cross-section.

FIG. 8 is a front plan view of the assembled projector 800 having a plurality of holes for transmission of sound from an interior to an exterior of the assembly. The plurality of speaker holes 805 is formed through the electronics assembly tray 105 in complementary opposition to an internal speaker (not shown) to facilitate transmission of sound from the internal speaker to an exterior of the assembly 800. In alternative embodiments, the speaker sits in the electronics assembly tray 500 behind a speaker grill or fabric covering to visually obscure the speaker and to provide some additional protection for the speaker.

FIG. 9 is a cross-section view illustrating a portion of the concave outer lens and inner lens as assembled in FIG. 1. The concave outer lens 900 may have a smooth outer surface 905 and an inner surface 910 that has a plurality of adjacent translucent lenses (alternatively referred to as "patterned" lenses) 912. In an alternative embodiment, either one or both of the inner and outer surfaces of the concave outer lens 900 may be patterned. The patterned inner surface 910 preferably has a repeating pattern, with each local peak 915 having a height $H_{outer}$ and adjacent peaks separated by a distance $SEP_{outer}$. In other embodiments, the local peaks may be separated within a certain maximum and minimum distance value to vary their respective focal points. In an alternative embodiment, the patterned inner surface 910 may have peaks of height $H_{outer}$ that varies between adjacent peaks but remains within a certain range of values over the surface of the concave outer lens 900. The inner lens 920 may have a smooth inner surface 925 and an outer surface 930 that has another plurality of adjacent and translucent lenses (also alternatively referred to as "patterned" lenses) 932. In an alternative embodiment, either one or both of the inner and outer surfaces (925, 930) of the inner lens 920 may be patterned. The patterned outer surface 930 preferably has a repeating pattern, with each local peak 935 having a height $H_{inner}$ and adjacent peaks separated by a distance $SEP_{inner}$. In other embodiments, the local peaks 935 may be separated within a certain maximum and minimum distance value to vary their respective focal points. In a preferred embodiment, the first plurality of adjacent lenses 912 of the concave outer lens 900 have optical axes (alternatively referred to as "principal axes") that are spaced farther apart than the principal axes of the second plurality of adjacent lenses 932 of the inner lens 920. In an alternative embodiment, the pattern of the inner surface 910 on the concave outer lens is proportionally larger than the pattern of the outer surface 930 of the inner lens 920.

The concave outer lens 900 may be separated from the inner lens 920 by a distance $D_1$ of between approximately 20-25 mm. A light source 940 may be disposed a distance $D_2$ of between approximately 7-11 mm from the patterned outer surface 930 of the inner lens 920 so that light emitted from the light source 940 passes through the inner lens 920 and then through the concave outer lens 900. In a further embodiment, the inner lens 920 may be fixed, and a new intermediate lens configured to move relative to the inner lens 920 using the electric motor 145 (see FIG. 1). In such an embodiment, the fixed inner lens and new intermediate movable lens collectively simulate a moving liquid surface, while the concave outer lens 125 is primarily decorative. In a further embodiment, each of the fixed inner lens and new intermediate lenses may be configured to move using the electric motor 145, with suitable gear reduction employed to move the lenses at different rates (i.e., frequencies) to simulate a moving liquid surface.

FIG. 10 is a top perspective view of an alternative embodiment for providing rotation and translation of the inner shell during operation. An internal lens 1000 may have a planar platform extension 1005 extending from an outer circumference of the lens. Front and rear pins (1010, 1015) extend from opposing ends of the inner lens 1000 to enable a rotatable and slidable coupling to respective hinges (not shown). As the internal lens 1000 is driven to translate, the planar platform is caused to alternately ride up a first platform ramp 1020 adjacent one end of the planar platform extension 1005 to cause the inner lens to 1000 to partially rotate in a first angular direction, down the same first platform ramp 1020 to return the inner lens 1000 to its angular starting position, and then up a second platform ramp 1025 on the other end of the inner lens 1000 and on a side opposite from the first platform ramp 1020 to partially rotate the inner lens 1000 in an angular direction opposite from the first partial rotation. The inner lens 1000 is then driven back off of the second platform ramp to return the inner lens 1000 to its angular starting position and the cycle may repeat.

FIGS. 11A and 12 are side plan and perspective views of an inner lens having a center of gravity (G) below a rotation and translation axis of the inner lens body. FIG. 11B is a close-up multi-position figure of FIG. 11A about 11B, with solid lines indicating a first position and dashed lines indicating a second position. The inner lens 1100 may have front and rear pins (1105, 1110) extending from opposing ends of the inner lens 1100 to enable a rotatable and slidable coupling to first and second hinges (not shown), such as the first and second hinges (110, 115) illustrated in FIG. 1. A driver arm 1115 may extend from one end of the inner lens 1100 and may have an integral top cap 1120 configured to slidably receive a lens driver such as an inner lens driver 1125 connected to a motor. As illustrated in FIGS. 11A and 11B, the inner lens driver 1125 may have a post 1130 extending from a disk 1135 for receipt into a sleeve 1140 of the top cap 1120. The disk 1135 may rotate about a rotation axis (B) to orbit the top cap 1120 in a circular path that effectively pushes, pulls and rotates the top cap 1120 to impart a rotational moment about a rotation axis and translational path defined by axis (A). The sleeve 1140 may have a first inner diameter that receives and accommodates a top of the post 1130, and a larger inner diameter toward a base of the post 1130 to allow the top cap 1120 to tilt slightly as the inner lens 1100 rotatably oscillates about the axis (A) without substantially impacting the base of the post 1130 which would limit rotational movement of the inner lens 1100. At least one inventive result of designing the gravity (G) of the inner lens to be below the rotation axis and translational path defined by axis (A), is smoother motion of the inner lens as it approaches an apex of its oscillatory movement towards either the right or left side of rotational travel. More particularly, with the center of gravity (G) below axis (A), if manufacturing tolerances are not adequate to remove unintentional gaps between mating surfaces of parts, the inner lens will not "fall" as it approaches its extreme left or right rotational position during operation. In an alternative embodiment, the driver arm 1115 may instead be a post, cavity or other coupler extending from or on an outer surface 1145 of the inner lens 1100 to engage an inner lens driver having a complementary design to engage the driver arm.

While various implementations of the application have been described, it will be apparent to those of ordinary skill in the art that many more embodiments and implementations are possible that are within the scope of this invention.

We claim:

1. A projector apparatus, comprising:

an oscillatable and translatable inner patterned lens;

an outer fixed patterned lens; and a light source configured to direct a portion of light through said oscillatable and translatable inner patterned lens and then through said outer fixed patterned lens, when said inner patterned lens is oscillating and translating.

2. The apparatus of claim 1, wherein said oscillatable and translatable inner patterned lens is a concave lens.

3. The apparatus of claim 1, wherein said oscillatable and translatable inner patterned lens comprises a repeating pattern across at least one of: an outer surface of said oscillatable and translatable inner patterned lens and an inner surface of said oscillatable and translatable inner patterned lens.

4. The apparatus of claim 1, wherein said outer fixed patterned lens is a concave lens.

5. The apparatus of claim 1 wherein said outer fixed patterned lens comprises a smooth outer surface.

6. The apparatus of claim 1 wherein said outer fixed patterned lens comprises one of: a generally elliptical cross section, a rectangular cross section, and a semicircular cross section.

7. The apparatus of claim 1 wherein said outer fixed patterned lens comprises at least one of: a colored translucent plastic, a clear glass, and a frosted glass.

8. The apparatus of claim 1 wherein said outer fixed patterned lens comprises one or more guide holes extending through said outer fixed patterned lens and one or more switches in said one or more guide holes, wherein said one or more switches are operable to at least one of: change an emission color of the light source, and provide sounds of liquid movement through a speaker.

9. The apparatus of claim 1 further comprising:

a filter disposed on said outer fixed patterned lens, wherein said filter blocks a portion of light from said light source that did not go through said oscillatable and translatable inner patterned lens before reaching said outer fixed patterned lens.

10. The apparatus of claim 9 wherein said filter is a thicker portion of said outer fixed patterned lens.

11. The apparatus of claim 9 wherein said filter is at least one of: an ink printed on a portion of said outer fixed patterned lens, a neutral-density filter disposed on a portion of said outer fixed patterned lens, and a color filtering disposed on a portion of said outer fixed patterned lens.

12. The apparatus of claim 1 wherein said light source is a plurality of colored light-emitting diodes (LEDs).

13. The apparatus of claim 1 wherein said oscillatable and translatabler inner patterned lens imparts a moving texture for modification through said outer fixed patterned lens for display upon a surface such as a ceiling to simulate a moving liquid surface.

14. A method of projecting a simulated moving liquid surface, comprising:

projecting, by a light source, a portion of light through an oscillatable and translatable inner patterned lens;

projecting a portion of the light projected through said oscillatable and translatable inner patterned lens through a fixed patterned outer lens; and filtering, by a filter disposed on said fixed patterned outer lens, a portion of light from said light source that did not go through said oscillatable and translatable inner patterned lens.

15. The method of claim 14 wherein said oscillatable and translatable inner patterned lens imparts a moving textured image for presentation to said fixed patterned outer lens for display upon a surface to simulate a moving liquid surface.

16. The method of claim 14 further comprising:

providing, via a speaker, sounds of liquid movement.

* * * * *